United States Patent [19]

Berger

[11] Patent Number: 4,626,095

[45] Date of Patent: Dec. 2, 1986

[54] BELT-HOLDER DRAWER FOR PHOTORECEPTOR BELT FOR COPIER APPARATUS

[75] Inventor: Jean-Claude Berger, Issoudun, France

[73] Assignee: Tetras, Paris, France

[21] Appl. No.: 734,813

[22] Filed: May 16, 1985

[30] Foreign Application Priority Data

May 16, 1984 [FR] France ..... 84 07566

[51] Int. Cl.[4] ..... G03G 15/00

[52] U.S. Cl. ..... 355/3 BE; 355/3 R; 355/16

[58] Field of Search ..... 355/3 BE, 16, 3 DR, 355/3 R

[56] References Cited

U.S. PATENT DOCUMENTS 4,470,690 11/1984 Hoffman ..... 355/3 BE
4,551,001 11/1985 Yokota ..... 355/3 BE
4,553,825 11/1985 Moulin et al. ..... 355/3 BE X

*Primary Examiner*—A. C. Prescott
*Attorney, Agent, or Firm*—Mason, Fenwick & Lawrence

[57] ABSTRACT

Photoreceptor belt-holder drawer for a copier apparatus comprising at least two cylinders having substantially parallel axes, at least one of the cylinders having a slight conicity and a bearing flange on its side having the smaller diameter and at least one other cylinder, called the tension cylinder, movably mounted and urged to provide tension to the belt.

Application to electrostatic copying.

10 Claims, 1 Drawing Figure

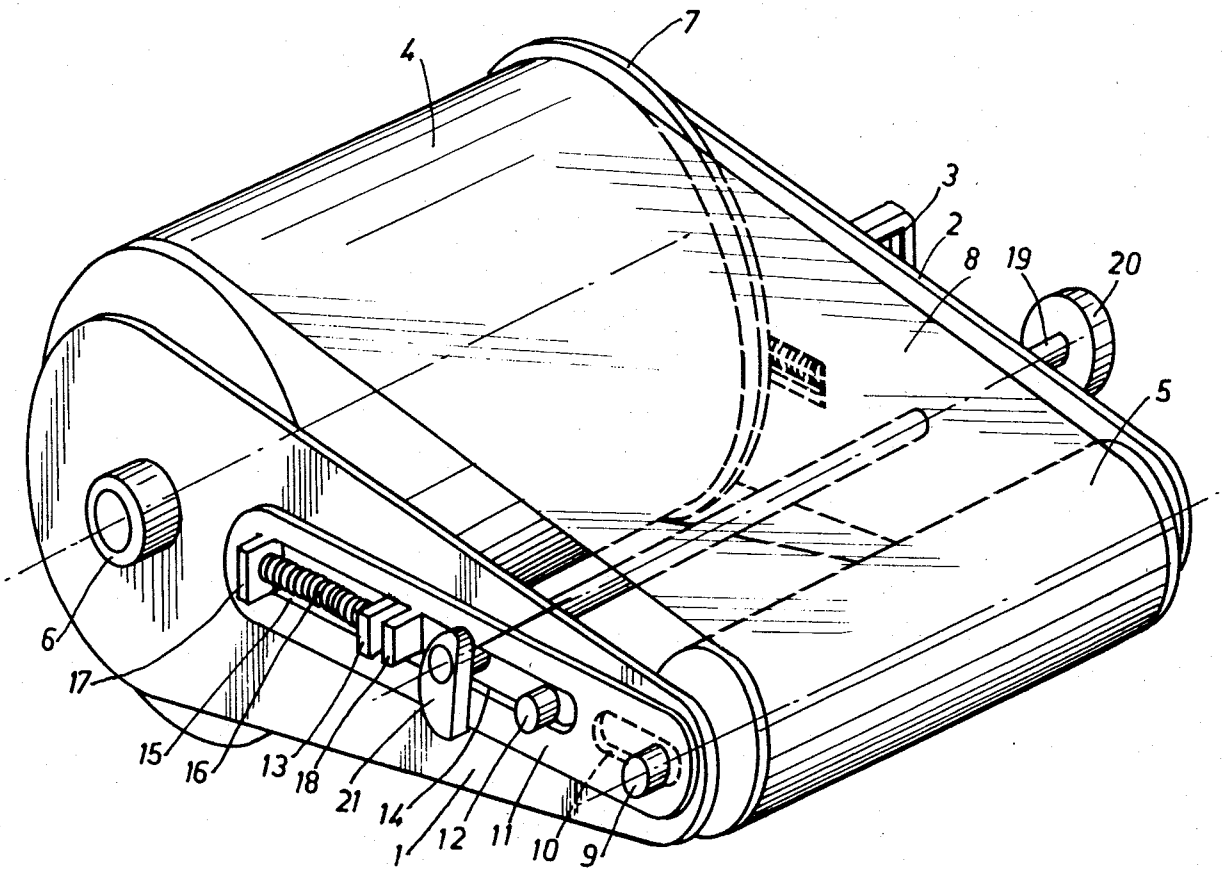
20
19
3
2
8
5
7
4
6
17
15
16
13
18
21
14
1
12
11
10
9

BELT-HOLDER DRAWER FOR PHOTORECEPTOR BELT FOR COPIER APPARATUS

BACKGROUND OF THE INVENTION

1. Field of the Invention

The present invention is a device for supporting a photoreceptor belt intended for use with a copier apparatus and especially with an electrostatic copier apparatus and, more particularly, a drawtype device allowing a rapid and easy change of the belt.

SUMMARY OF THE PRIOR ART

According to the prior art covering electrostatic copier apparatus, it is known to create on an electrophotographic support such as a drum, belt or web a latent image constituted by charges corresponding to the subject-matter of the original document to be reproduced. These charges will allow the provisional fixation of the ink particles or other products ensuring the coloration of the copy, generally known as "toners". In the following description, and in order to simplify the explanation of the present invention, reference will be made to ink, although it will be understood that the invention applies to numerous kinds of particles allowing coloration of the copy support by transfer, by impression, by hot or cold pressure, by developing, these "inks" of one or several components, being as such or micro-encapsulated. Reference will be made, for example, to the technical methods described in French patent application No. 79 24267 and European patent application No. 82 1097060.

In the first of these above-mentioned patents, the belt constituted by a band or tape of resilient plastic material covered by an electrophotographic layer, is looped about two cylinders having axes that are approximately parallel and of substantially different diameters. In order to mount the belt or change it, the axis of the small cylinder is displaced in a radial plane towards the large cylinder, then they are drawn apart, the small cylinder still radial with respect to the large cylinder; two return springs urge the ends of the axis of the small cylinder in order to ensure the tension of the belt. It is obvious that if this belt is not exactly a rectangle closed upon itself but is, for example, slightly trapezoidal, the two axes will not be parallel and the belt will laterally deviate during the course of its travel. This noted patent utilizes a slight angular shifting or displacement which is continuously ensured, in a plane orthogonal to the said radial displacement plane, which brings the belt back into operating position once said belt has a tendency to deviate therefrom.

It will be seen that the mounting of the cylinder having a small diameter ensures the regular overall tension of the belt (moving in radial plane with respect to the large cylinder) and prevents its deviation (moving in a tangential plane orthogonal to the said radial plane with respect to the large cylinder).

The drawback of this solution lies in the fact that the small cylinder is mounted so as to perform two functions and thus, one function may be considerably disturbed by the other, especially when permanent deformations intervene after a certain operating time.

According to the invention, this unfortunate interaction between the two correcting functions, and the difficulties that result therefrom, especially the necessity of correcting the angular adjustments in the two orthogonal planes, are eliminated by having each of the cylinders perform a single correcting function, one ensuring putting the belt under uniform tension in space and in time, and the other preventing the lateral deviation of the said belt.

In order to do this, one of the cylinders is mounted radially slidable with respect to the other and urged by return forces ensuring the uniform tension in time and in space; the other cylinder has a slight conicity tending to displace the belt from the side of the cone having the smaller diameter and bringing it in abutment with a flange coaxial to the cylinder. Preferably, the cylinder having a small diameter ensures the first function and the cylinder having the large diameter ensures the second, although the opposite disposition falls within the scope and spirit of the present invention. It will be noted, furthermore, that for various reasons due to the requirements of copier apparatus in which the belt is mounted, the two cylinders can have substantially the same diameter, to within their conicity, and that a system having more than two cylinders can be envisaged, with at least one of these cylinders presenting the conicity and at least one cylinder, called tension cylinder, ensuring the putting under uniform tension of the belt in time and in space. It will also be noted that one of the advantages of the device according to the present invention resides in the fact that if the belt is progressively deformed through wear, a self-adjustment occurs and experience has shown that the maintainance in operating position of the belt remains ensured.

The present invention concerns a photoreceptor belt-holder drawer for a copier apparatus, comprising at least two cylinders having substantially parallel axes, at least one of the two cylinders having a slight conicity and provided with a bearing flange on its smaller side, and at least one cylinder, called a tension cylinder, ensuring the tension of the belt under the effect of the return forces exerted.

In the present embodiment, reference is only made to two cylinders, but it is obvious that several cylinders may be utilized, at least one of which fulfills the first function and at least a second cylinder fulfills the second function.

Evaluating the most appropriate angle of conicity essentially depends upon the requirements set by the belt manufacturer. As the tolerances set for the belt are increasingly strict the lower may be the angle of conicity, the single important element being the existence to be a rectangle closed upon itself, the operator can assemble it in either one of the displacement directions. Therefore, if the belt is slightly trapezoidal, which is hardly visible at a glance, the operator can mount it with the conicity of the belt on the same side or on the side opposite that of the cylinder. It thus appears that in any event the choice of the conicity of the cylinder must take into consideration, the conicity of the belt working in the direction of lateral return of the belt or in counter direction thereto; this brings about a conicity of the cylinder greater than that tolerated by the belt, the spring-mounted cylinder ensuring the contact between the cylinder-cone and the belt by self-adjustment of the radial distance between the two cylinders.

With respect to the integration of this belt assembly in the copier apparatus itself, it will be recalled that this type of reproduction apparatus is generally constituted in a structure formed by two parallel plates connected to each other by cross-pieces and between which are mounted cylinders and other means for the circulation of the belt, copies and where necessary the original documents, as well as all the intervening elements (lighting, electrostatic devices, inking, heating, etc.). The access to the various elements is frequently available through the sides, i.e. by an opening provided in one of the plates. Thus, for the photoreceptor assembly, the belt is generally mounted in a drawer which can be extracted laterally and thus substantially parallel to the axes of the cylinders and orthogonally to the displacement direction of the belt and the copies.

This drawer mounting is of any conventional type and preference will not be given to any specific type in the following description with respect to any given solution. The function of the drawer is thus to allow the extraction of the belt-holder assembly, changing the belt, putting back into place the belt-holder assembly and the driving in rotation of at least one cylinder (generally that having the larger diameter). Since the belt occupies practically the essential portion of the periphery of this assembly, utilization is generally made of internal sliding means, for example, slides or pins at least one of which is able to act, by engaging or interlocking with one of the cylinder axes, to ensure the driving of the belt. In the embodiment described herein-below, the tubular axis of the large-diameter cylinder will become engaged, for example, with a driving pin by any suitable means, the positioning of the drawer being able to be ensured either by at least one other pin or slideways, or by integral mounting elements of the flanges of the drawer which are inserted in the plates of the structure of the machine.

All these means can be conventional and will not be described in detail in the present specification.

In order to render more apparent the technical features and the advantages of the present invention, an embodiment will now be described, it being understood that this embodiment is in no way limiting with respect to the practice of the inventition and to the applications that can be made thereof.

BRIEF DESCRIPTION OF THE DRAWING

The single FIGURE is a schematic perspective view of a belt-holder drawer in accordance with the invention.

DETAILED DESCRIPTION OF THE PREFERRED EMBODIMENT

The belt-holder drawer comprises essentially two parallel side-plates 1 and 2, connected by cross-pieces (not shown for simplicity), one being provided with a knob 3 or equivalent in order to facilitate the extraction of the assembly.

Between the two side-plates are mounted cylinders 4 and 5 of respectively large and small diameter.

Large cylinder 4 is mounted for rotation on a fixed axis in the side-plates 1 and 2 by means of a tubular axle 6 and bearings, ball bearings or other suitable devices. As has been indicated herein-above, axle 6 can be threaded on a driving pin to cause rotation with which it. Cylinder 4 is slightly conical and on its side having the smaller diameter, it has a bearing flange 7 against which rests the edge of the belt 8.

Small cylinder 5 is slidably mounted by the ends of its axle 9 in the oblong slits 10 of the side-plates 1 and 2 thus allowing small cylinder 5 to be moved closer to or farther from the large cylinder 4. The ends 9 of the axle of cylinder 5 are rotatably mounted in two bearing plates 11 sliding on each of the side plates 1 and 2. The figure only shows the mounting of one shaft end 9, the other end being behind side plate 2 and not visible in the figure, but being symmetrical to the first end bearing plate; 11 slides radially with respect to large cylinder 4 for example due to stud 12 and to tongue 13 integral with the side plate 1 which pass through oblong windows 14 and 15 of plaquette 11. The bearing plate 11 is urged towards the right-hand side on the drawing by a return spring 16 stretched between the tongue 13 of the side plate 1 and the tongue 17 of the bearing plate 11. Thus, the bearing plate 11 is urged towards the right, thereby tending to separate the two cylinders 4 and 5 from each other. It is belt 8 which, by being put under tensile stress maintains the distance between the cylinders. It will be understood that according to the form of the belt 8 within the tolerance limits imposed by the manufacturer, while taking into consideration possible deformations in time, symmetrical bearing plate 11 can assume different positions, thus being able to modify the parallelism by angularly shifting small cylinder 5 with respect to the large cylinder 4. A shaft 7 19 integral with control knob 20 bears on each side a cam 21 which pushes tongue 8 integral with the bearing plate towards the left, against the urging of spring 16. This spring 16 displaces towards the left the bearing plate 11 and end 9 of the axis of the small cylinder 5 which moves in the slit 10 of the side-plate 1. The same displacement occurs on the side of the side-plate 2, thus bringing closer together the two cylinders 4 and 5 into parallel position. It is thus easy to withdraw belt 8 and replace it by another. Thereafter, cams 21 are released by bringing knob 20 to its initial position. Springs 16 brings back the new belt 8 under tension by spreading cylinders 4 and 5 apart from each other.

It is obvious that it is possible to replace the tension devices 16 by any equivalent means ensuring the resilient spreading apart of the two cylinders 4 and 5, for example a single spring urging the two axis ends 9 through the intermediary of a transversal bar, or by bringing together cams by any other means so as to ensure the relative bringing together of the two cylinders 4 and 5.

It will also be noted that according to the copiers, a complete operating cycle running from the taking of the picture to the printing of the copy and the removal of the latent image on the photoreceptor belt normally occurs within one or two revolutions of the photoreceptor belt; the belt-holder system according to the present invention can be applied to all types of operating cycles.

The present invention can be applied equally as well to direct copiers as to all systems that originate from them (fac-similes, printers or others) once a photoreceptor belt is utilized, whatever the operation principle. It is especially suitable for electrostatic copying, as is apparent by the foregoing description.

The present invention is not limited to the embodiment described and represented herein-above; it can be adapted to numerous variants available to the man skilled in the art without departing from the scope and spirit of this invention.

What is claimed is:

1. Belt holder drawer for a copier apparatus comprising first and second spaced cylinders and an endless belt looped thereon, (a) said first cylinder having a slight conicity with one side having a smaller diameter than the other side, (b) a bearing flange adjacent the side of the first cylinder having the smaller diameter, (c) means for mounting said first cylinder for rotation about a fixed axis, (d) means for mounting said second cylinder for rotation about the axis thereof, (e) means for permitting movement of the second cylinder radially thereof towards and away from said first cylinder, and (f) means for urging said second cylinder away from said first cylinder.

2. The belt holder drawer of claim 1, said belt being looped only on said first and second cylinder.

3. The belt holder drawer of claim 1, said first cylinder having a larger diameter than said second cylinder.

4. The belt holder drawer of claim 1, and further comprising means for selectively moving one said cylinder towards said other cylinder to permit change of belts.

5. The belt holder drawer of claim 1, said first cylinder having a hollow axle, and means for drivingly engaging a shaft in said hollow axle.

6. The belt holder drawer of claim 1, said belt being a photoreceptor belt.

7. The belt holder drawer of claim 1, said drawer comprising first and second side plates, said mounting means for said second cylinder comprising a bearing plate adjacent each of said side plates, said second cylinder comprising an axle having the ends thereof each extending into a said bearing plate, said means for permitting movement comprising:

(a) slits in said side plates, (b) means for supporting each said bearing plate for movement on each said side plate towards and away from said first cylinder, and (c) said ends of said axles extending through said slits.

8. Belt holder drawer for a copier apparatus comprising first and second spaced rotatably mounted cylinders and an endless belt looped thereon, (a) said first cylinder having a slight conicity with one side having a smaller diameter than the other side, (b) means adjacent the side of the first cylinder having the smaller diameter for limiting movement of said belt laterally of said first cylinder toward said smaller diameter side thereof, and (c) means for placing a tension on said endless belt.

9. The belt holder drawer of claim 8, said movement limiting means comprising a flange on said first cylinder.

10. The belt holder drawer of claim 8, said last mentioned means comprising:

(i) means for mounting one said cylinder for substantially radial movement, and (ii) mean for urging said one cylinder in a direction to apply tension to said endless belt.

* * * * *